US005864999A

United States Patent [19]

Wallin

[11] Patent Number: 5,864,999

[45] Date of Patent: Feb. 2, 1999

[54] MODULAR WALL SYSTEM

[76] Inventor: Arne B. Wallin, 1912 South Orr Lake Road, Elmvale, Ontario, Canada, LOL 1PO

[21] Appl. No.: 980,365

[22] Filed: Nov. 28, 1997

[51] Int. Cl.[6] ..... E02D 27/00

[52] U.S. Cl. ..... 52/293.1; 52/250; 52/293.3

[58] Field of Search ..... 52/250, 251, 258, 52/309.17, 292, 293.1, 293.3, 294, 295, 602, 284

[56] References Cited

U.S. PATENT DOCUMENTS

| | | | |
|---|---|---|---|
| 996,262 | 6/1911 | Kurtz | 52/293.1 X |
| 1,834,892 | 12/1931 | Betzler | 52/293.1 X |
| 2,270,846 | 1/1942 | Hines | 52/250 X |
| 2,350,018 | 5/1944 | Dean et al. | 52/250 X |
| 4,186,160 | 1/1980 | Landreth | 52/293 |
| 4,512,126 | 4/1985 | Walston | 52/251 |
| 4,823,534 | 4/1989 | Hebinck | 52/251 |

FOREIGN PATENT DOCUMENTS

| | | | |
|---|---|---|---|
| 94533 | 6/1983 | Japan | 52/292 |
| 1008358 | 3/1983 | U.S.S.R. | 52/292 |

*Primary Examiner*—Creighton Smith

[57] ABSTRACT

A modular wall system provides wall panels with vertical flanges that are anchored between a footing and lintel by coupling means that extend into concrete-filled troughs. Imbedded reinforcing bars placed within the wall panels and/or flanges protruding therefrom for engagement with transverse reinforcing bars within the concrete-filled trough.

10 Claims, 5 Drawing Sheets

MODULAR WALL SYSTEM

FIELD OF THE INVENTION

This invention relates to the construction industry. More particularly it addresses a modular wall system based upon precast concrete panels and accessory elements that may be erected on a site to provide a concrete wall suitable for a building.

BACKGROUND TO THE INVENTION

Construction techniques based upon the use of precast panels for forming walls are known. This includes panels which are tipped-up for positioning on a foundation and then fastened together by various means.

Flanged concrete wall panels are shown in U.S. Pat. No. 1,834,892 to Betzler. U.S. Pat. No. 4,432,176 to Balzer depicts flanged wall elements each terminating in legs at their bottom ends to support the walls and permit reinforcing rods running there beneath to be embedded within a cast concrete floor.

U.S. Pat. No. 2,094,458 to Lawler depicts wall panels held in alignment by vertical concrete "studs" or posts that have wall engaging grooves along their vertical edges. Details of the connection between the bottoms of these studs and a base support are not provided. At their top ends, protruding tie rods allow superstructure to be erected thereon.

A similar patent is U.S. Pat. No. 2,911,817 to Smith which also depicts the use of "lintel troughing blocks" positioned along the top of a course of blocks and filled with concrete.

In U.S. Pat. No. 3,372,519 to Russell, precast concrete wall panels with protruding, threaded reinforcement rods along their top edges are capped by precast concrete floor panels that have preformed holes in register with the protruding rods.

U.S. Pat. No. 2,208,589 to Leemhuis depicts vertical wall panels provided with protruding vertical flanges. The foundation member supporting the wall panels may be poured to envelope a portion of the base end of each wall panel which is notched to provide a keying effect. The top ends of inter-fitting, opposed panels are capped by a wooden lintel.

U.S. Pat. No. 3,685,241 to Cooper depicts a wall system having hollow vertical panels formed of two opposed facing panels. Such panels rest on a footing aligned by protruding locating pins set herein with grout filling a cavity formed along the lower surface of the wall panel. A horizontal trough formed along the top edge of the wall panels is filled with reinforced concrete once the panels are erected.

U.S. Pat. No. 4,461,130 to Shubow depicts the use of concrete "bond beams" positioned along the tops of wall panels and forming supporting footings for the next, higher course of wall panels. The underside of the bond beams are channelled to receive and embrace the tops of the wall panels, and are pierced by openings to permit passage of vertical reinforcing rods therethrough. Horizontal reinforcing rods embedded in concrete lie within troughs formed on the upper sides of the bond beams.

U.S. Pat. No. 4,328,651 to Gutierrez shows a beam and post construction by which vertical concrete posts have reinforcing rods protruding downwardly to receive and engage with the ends of lower beams that have panel-receiving grooves formed therein. Concrete grout is applied to embed the protruding rods and anchor the posts in place.

In U.S. Pat. No. 1,514,714 to Needham preformed, flanged concrete wall panels rest within a trough formed in a footing beam. These wall panels are provided with upwardly protruding reinforcing bars that are capped by a cast-in-place lintel beam.

A need exists for an improved system for supporting and fastening precast wall such panels in position. This invention addresses such a need by providing a modular wall structure that can quickly be erected on a job site providing a full load-bearing and weather-tight wall.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

The invention in one broad aspect is directed to a modular wall system comprising:

(a) a plurality of wall panels each having a wall portion and a rearwardly extending flanged portion;

(b) a footing member having a footing trough defined by first and second trough sidewalls positioned beneath and supporting two or more of said panel members; and (c) lower coupling means protruding downwardly from the lower ends of each of said panels;

wherein the wall portion of each of said wall panels extends along the top of the first of the trough side walls of said footing trough, the flanged portion of each wall panel extends outwardly from said panel by an amount sufficient to extend across said footing member to rest upon the second of said trough sidewalls and thereby support said wall panel when erected in an upright position and said lower coupling means protrude sufficient to extend downwardly into the trough of said footing member to be imbedded in a binder or grout such as concrete, when such footing member trough is filled with concrete.

By a further feature of the invention a lintel member is provided for positioning above and being carried along the tops of two or more of said panel members, overlying said wall and flanged portions, said lintel member having a lintel trough formed therein with perforations formed along the lower surface of said trough. Upper coupling means protrude upwardly from the upper ends of each of said panels for penetration into said lintel trough through said perforations to be imbedded in a grout or binder such as concrete when said lintel trough is filled with such binder.

Optionally, particularly, each panel may have a second longitudinal flanged portion positioned for overlying said footing trough when the panel is erected into an upright position.

While the wall portion and flanged portions may be integrally formed, they may also be separately formed and held in place by inter-engaging elements or adhesives when erected.

By a further broad aspect of the invention each wall panel is non-integral with its associated flanged portion, but is confined by the inter-fitting vertical edges of adjacent flanged portions to be supported in an upright orientation. Collectively, such wall portions and flanged portions constitute wall elements.

By a further feature of the invention either or both of said upper and lower coupling means preferably engage with reinforcing means imbedded within the binder respectively present within said footing and lintel troughs. More preferably, said reinforcing bars extend between adjacently located footings and/or lintel members.

Optionally, said footing member may be provided with a drainage trough positioned adjacent said footing trough outwardly of the location of the wall panel for receiving water draining down the outer surface of the wall panel.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 2:
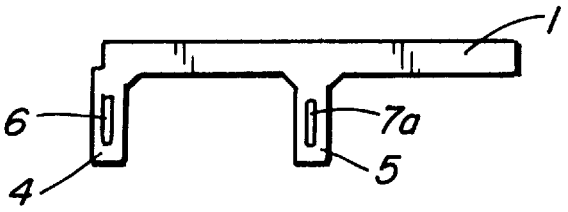
FIG. 2 is an end view of FIG. 1.
Figure 1:
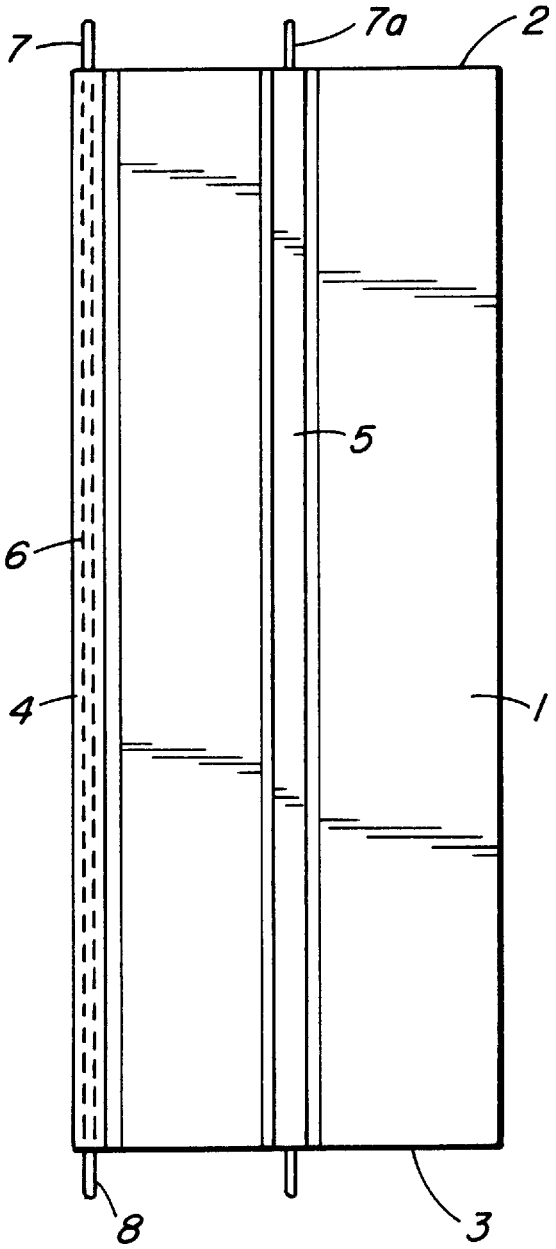
FIG. 1 is a face view of a wall panel with two protruding flanged leg portions.
Figure 3:
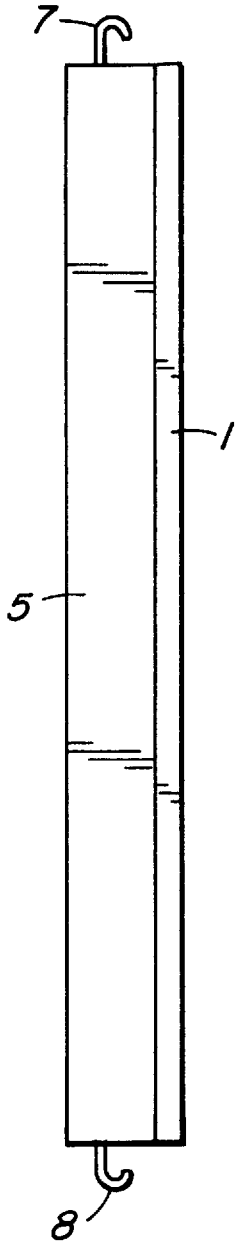
FIG. 3 is a plan view of FIG. 1.

In FIGS. 1, 2 and 3 a wall panel 1 is shown having upper 2 and lower 3 ends and a principle 4 and optional secondary 5 leg panel positioned to form and "F" cross-section. Without the secondary leg panel 5, an "L" cross-section is formed. The wall panel, and principle leg panel 4 may be integrally formed, preferably by casting or by extrusion. The material for these components may be a cementatious substance such as concrete, or an equivalent material. While shown as a unitary combination in FIGS. 1, 2 and 3, these parts may be separately formed for subsequent interconnection.

Imbedded within the principle leg panel 4 is shown a reinforcing bar 6 that protrudes from the top and bottom ends of the principle and secondary leg panels 4 and 5. The upper and lower protruding portions 7 and 8 respectively are hooked to serve as coupling means to engage with concrete, grout or other cementatious material, and optionally reinforcing bars as further described below.

The protruding portions 7 and 8 serve as coupling means to couple the wall and leg panels to a rooting 9 and lintel 10 shown in FIGS. 7–9 and 4–6 respectively.

Figure 7:
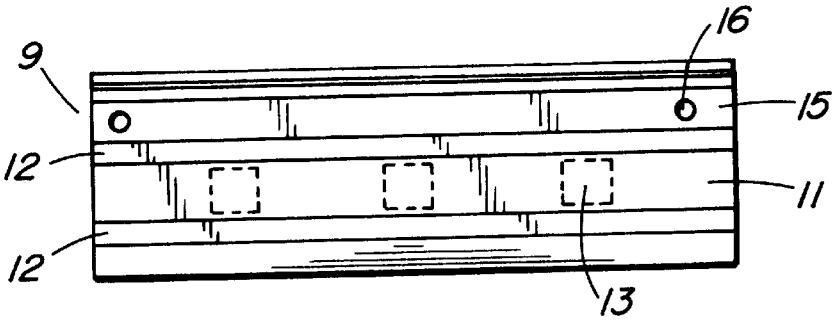
FIG. 7 is a plan view of a footing member for supporting wall panels.
Figure 9:
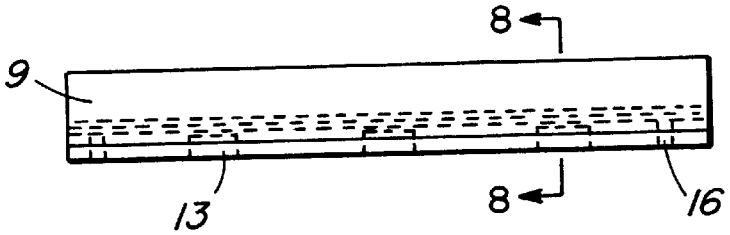
FIG. 9 is an end view of FIG. 8.
Figure 8:
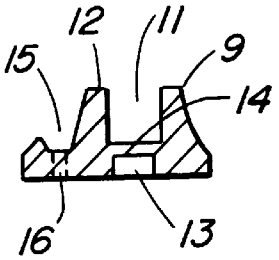
FIG. 8 is a front view of FIG. 7.

In FIGS. 7–9 a footing member 9 is of extended length is provided with a trough 11 and trough sidewalls 12. Optional pockets 13 leave knock-out portions 14 in the bottom of each footing trough 11 to assist in stabilizing the footing. A secondary drainage trough 15 may optionally be provided along side the footing member 9 preferably integrally formed as by casting. Drainage holes 16 may intermittently perforate the bottom of the drainage trough 15.

Figure 4:
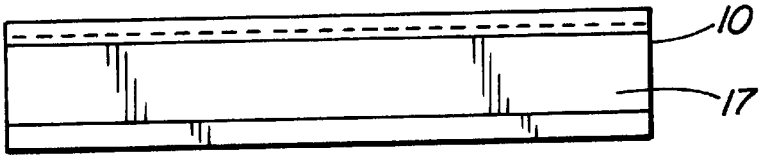
FIG. 4 is a plan view of a lintel for overlying wall panels.
Figure 5:
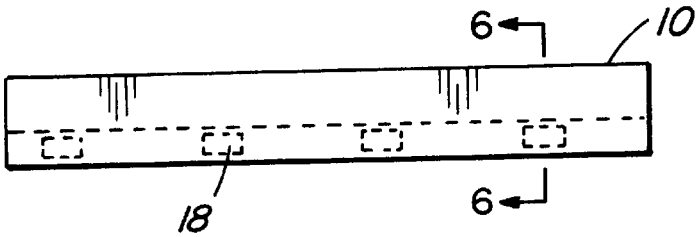
FIG. 5 is a face view of FIG. 4.
Figure 6:
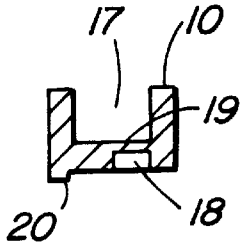
FIG. 6 is a cross-sectional end view of FIG. 5.

In FIG. 4, 5 and 6 a lintel 10 is provided with a lintel trough 17 and pockets 18 to provide knock-out portions 19 in the bottom of the lintel trough 17. The lintel 10 is of a width to span the wall panel 1 and principle leg panel 4. It may optionally have a flanged overhang 20 that will overhang the upper end 2 of the wall panel 1.

Figure 11:
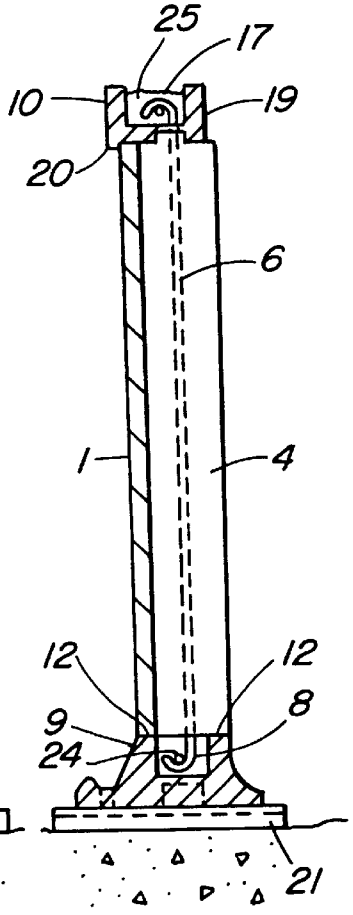
FIG. 11 is an edge view of FIG. 10.
Figure 10:
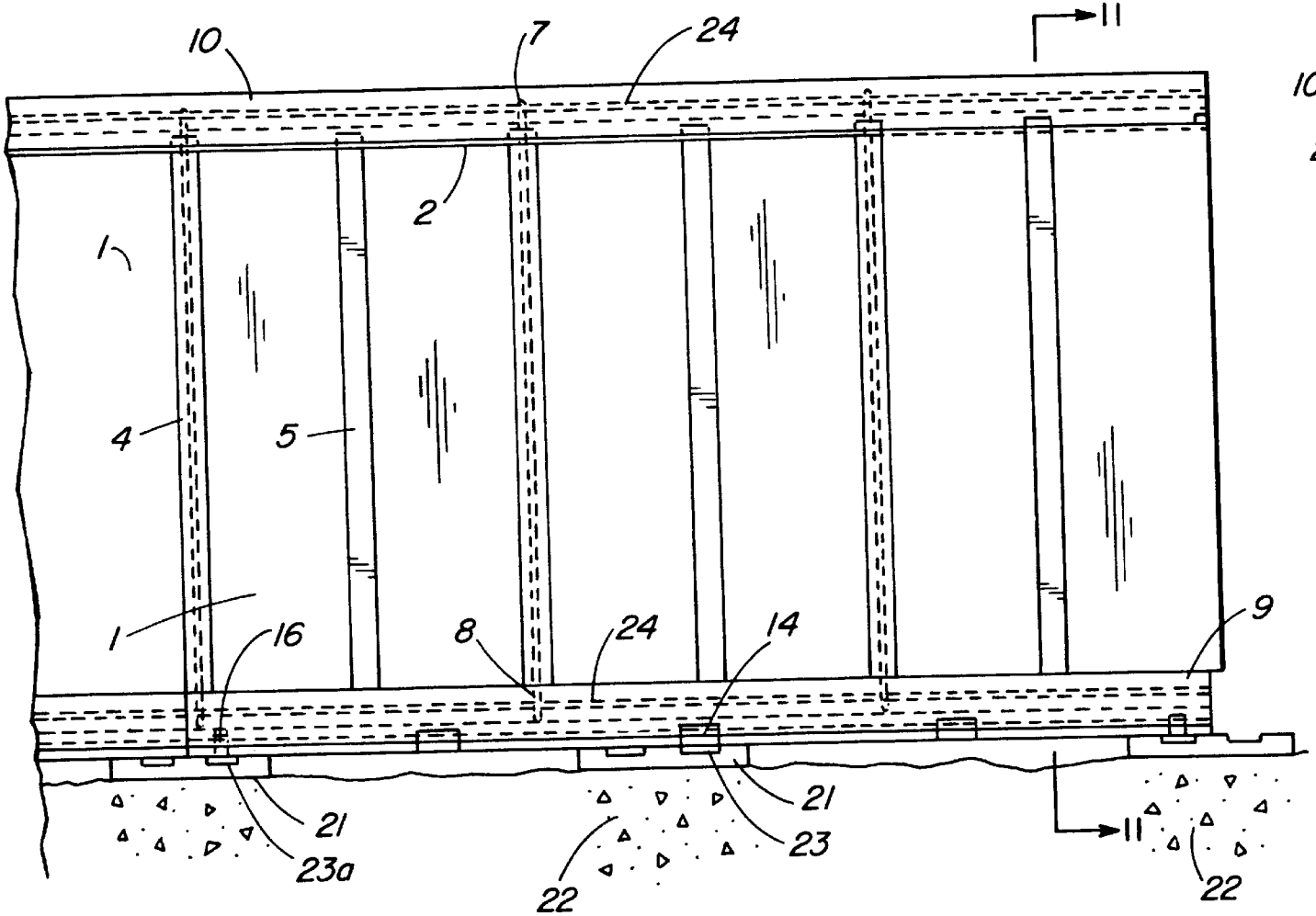
FIG. 10 is a face view of an assembled wall system incorporating wall panels, footing members and lintel components.
Figure 13:
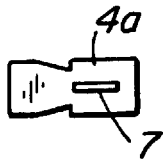
FIG. 13 is a top view of FIG. 12.
Figure 14:
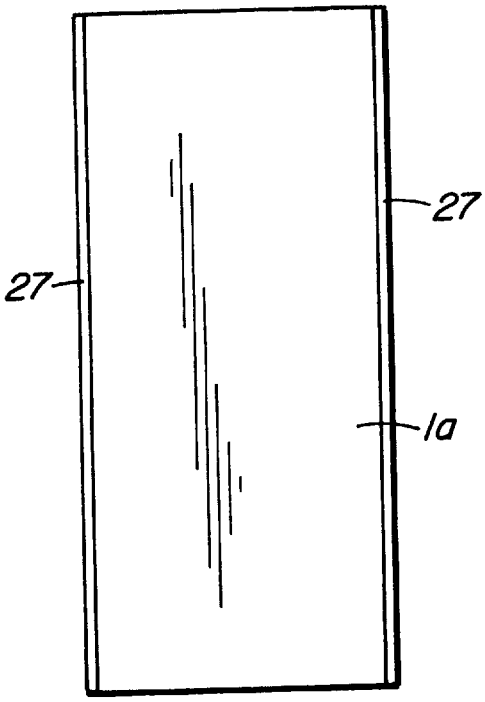
FIG. 14 is a face view of an alternate wall panel that interfits with the leg panel of FIG. 12.

The assembled wall system shown in FIGS. 10 and 11 provides for footing pads 21 position an consolidated ground, e.g. containing aggregate 22 at intervals. The pads 21 have recesses 23 to contain grout extending through the footing trough knock-out portions 14 to stabilize the footing 9 on the pads 21.

Optionally, some pads may have recesses 23 that are transverse grooves 23*a* which are aligned with the drainage holes 16 in the drainage trough 15. This provides a means for drainage water to be lead away from the footings.

The wall panels 1 are positioned along one trough sidewall 12 and the leg panel 4 extends transversely across the footing member 9, spanning two trough sidewalls 12. The lower coupling means 8 is preferably hooked to engage with reinforcing means, such as a reinforcing bar 24 that is imbedded in a cementatious materials, such as concrete or mortar, that is placed in the footing trough 11. When two footing members 9 abut, these reinforcing bars 24 extend between adjacent sections, anchoring them together. Further such bars 24 may be fastened intermittently to the trough bottom between leg panels 5.

Along upper ends 2 of the panels 1 the lintel 10 is positioned with the optional overhang 20 aligned with the upper edges of each panel. The upper coupling means 7 protrude through the opened knock-out portions 19 into the lintel trough 17 to engage with reinforcing means, e.g. reinforcing bars 24 and to be imbedded in a cementatious filling 25.

If optional secondary leg panels 5 are present they may also optionally be provided with anchor means 7*a* which are similarly imbedded and anchored.

Figure 12:
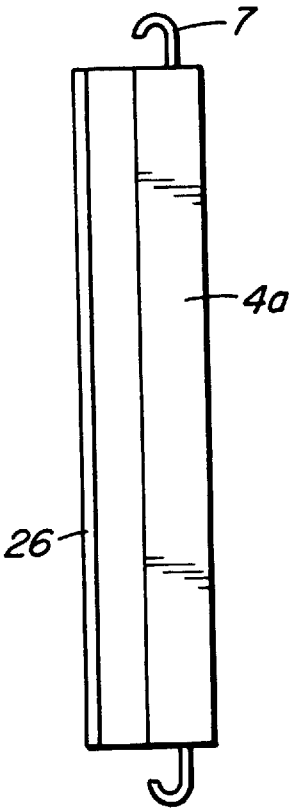
FIG. 12 is a face view of a separate leg panel.
Figure 15:
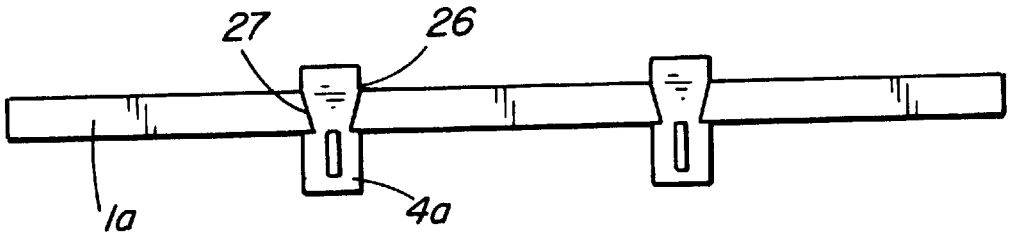
FIG. 15 is an assembly plan view of the wall and leg panels of FIG. 14 and 12.

While the wall and principle leg panels 1 and 4 of FIG. 2 are shown as being integrally formed, FIGS. 12–15 show an optional system wherein these elements are formed separately. In FIG. 12 a leg panel 4*a* has a dove-tailed edge 26. The separate wall panels la have bevelled outer edges 27. When assembled as shown in FIG. 15, these bevelled edges 27 interfit on the respective sides of the dove-tailed edges 26 of each leg panel 4*a*. The presence of the overhang 20 in this variant helps maintain the wall panels 1*a* in position.

Figure 16:
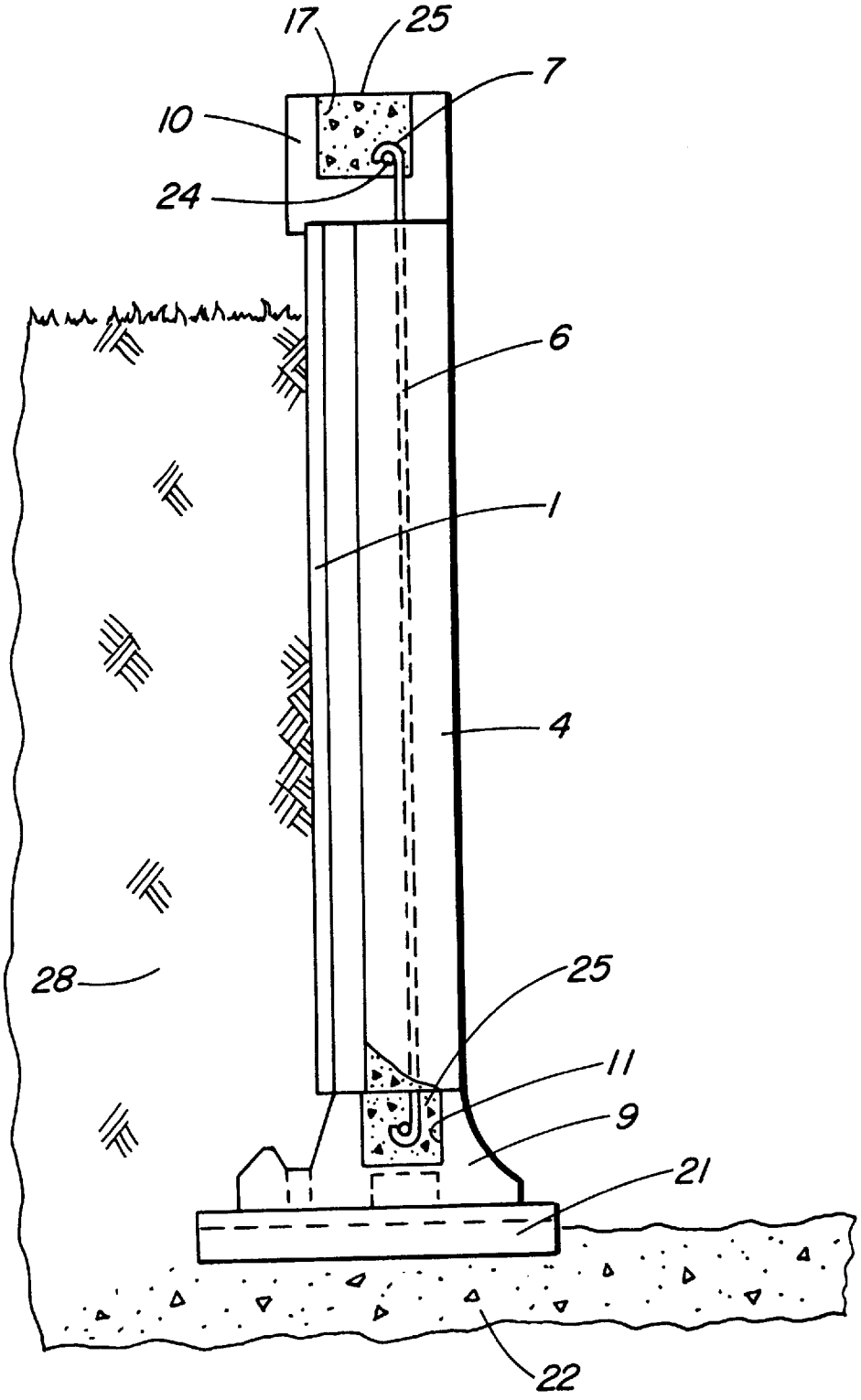
FIG. 16 is a cross-sectional view similar to FIG. 11 with back-fill present against the wall panel 1.

A further cross-sectional view of the assembled wall in FIG. 16 shows the components in place and back-fill 27 present against the buried wall panel 1.

The foregoing system operates to provide a modular wall that is based on the "I"beam principle. The upper lintel 10 and lower footing 9 are anchored together by leg panels 4 that act as the skeleton of the web. The panels 1 and 1*a* can further stiffen the structure, but may optionally be merely curtain-walls.

The system is erected with minimal activity on site. A key feature is the use of the respective footing and lintel troughs 11 and 17 to carry concrete, or another appropriate binder, which is installed after the other components are assembled.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property are claimed as follows:

1. A modular wall system comprising:

(a) a plurality of wall panels each having a wall portion and a rearwardly extending flanged portion;

(b) a footing member having a footing trough with two trough sidewalls for positioning beneath two or more of said panel members: and (c) lower coupling means protruding downwardly from the lower ends of said flanged portions of said panels;

wherein the wall portion of each panel extends along the top of one of the trough side walls, the flanged portion of each wall panel extends outwardly from said panel by an amount sufficient to extend across said footing member to rest upon the trough sidewalls and thereby support said wall panel when erected in an upright position, and said lower coupling means protrude sufficiently to extend downwardly into the footing trough of aid footing member to be embedded in a binder when such footing member trough is filled with such binder.

2. A wall system as in claim 1 comprising a further lintel member for positioning above and to be carried along the top of two or more of said panels, overlying said wall and flanged portions of each of said panels, said lintel member having a lintel trough formed therein with penetration zones formed along the lower surface of said trough, said flanged portions having upper coupling means protruding upwardly from the upper ends of each of said flanged portions for penetration into said lintel trough through said penetration zones to be imbedded in a binder when said lintel trough is filled with a binder.

3. A wall system as in claim 1 wherein each panel has a second longitudinal flanged portion positioned for overlying said footing trough when said panel is erected into an upright position.

4. A wall system as in claim 1 wherein said footing member is provided with a secondary drainage trough positioned adjacent said footing trough outwardly of said trough side walls for receiving water draining down the outer surface of the wall panels when erected to form a wall.

5. A wall comprising:

(a) a plurality of upright wall elements each having a wall portion and a rearwardly extending flange portion;

(b) a footing member having a footing trough with two trough sidewalls positioned beneath two or more of said panel members, the wall portion of each of said wall panels extending along the top of one of the said trough sidewalls the flange portion of each said wall elements extending outwardly from said wall portion to extend across said footing member to rest upon the other of said trough sidewalls and thereby support said wall portion;

(c) lower coupling means protruding downwardly from the lower ends of each of said panel elements to extend into the footing trough of said footing member and be imbedded in a binder placed within said footing trough; and (d) a lintel member positioned above and carried along the top of two or more of said panel elements, overlying said wall and flange portions, said lintel member having a lintel trough formed therein with penetrations formed along the lower surface of said trough, said flange portions of said panel elements having upper coupling means protruding upwardly from the upper ends of said flange portions penetrating into said lintel trough through said penetration and imbedded in a binder placed within said lintel trough.

6. A wall as in claim 5 wherein said upper and lower coupling means each engage with reinforcing bar that is imbedded within the binder respectively present within said footing and lintel troughs.

7. A wall as in claim 6 wherein said reinforcing bars extend between adjacently located footings members.

8. A wall as in claim 5 wherein said reinforcing bars extend between adjacently located lintel members.

9. A wall as in claim 5 wherein said wall and flange portions are integrally formed.

10. A wall as in claim 5 where said wall and flange portions are separately formed with vertical edges that are shaped to interfit with each other and support the wall portions in an upright orientation.

* * * * *